US007286642B2

(12) United States Patent
Ishikawa et al.

(10) Patent No.: US 7,286,642 B2
(45) Date of Patent: Oct. 23, 2007

(54) X-RAY TUBE CONTROL APPARATUS AND X-RAY TUBE CONTROL METHOD

(75) Inventors: Masayoshi Ishikawa, Hamamatsu (JP); Takane Yokoi, Hamamatsu (JP); Tsutomu Nakamura, Hamamatsu (JP); Yutaka Ochiai, Hamamatsu (JP); Kinji Takase, Hamamatsu (JP)

(73) Assignee: Hamamatsu Photonics K.K., Shizuoka (JP)

( * ) Notice: Subject to any disclaimer, the term of this patent is extended or adjusted under 35 U.S.C. 154(b) by 0 days.

(21) Appl. No.: 10/510,212

(22) PCT Filed: Apr. 4, 2003

(86) PCT No.: PCT/JP03/04357

§ 371 (c)(1),
(2), (4) Date: Jun. 27, 2005

(87) PCT Pub. No.: WO03/086028

PCT Pub. Date: Oct. 16, 2003

(65) Prior Publication Data

US 2006/0153335 A1 Jul. 13, 2006

(30) Foreign Application Priority Data

Apr. 5, 2002 (JP) ..... 2002-103881

(51) Int. Cl.
*H05G 1/54* (2006.01)

(52) U.S. Cl. ..... 378/111; 378/109; 378/113

(58) Field of Classification Search ..... 378/91, 378/101, 109–115, 118, 901
See application file for complete search history.

(56) References Cited

U.S. PATENT DOCUMENTS

| | | | | |
|---|---|---|---|---|
| 4,160,906 | A * | 7/1979 | Daniels et al. | 378/97 |
| 4,797,905 | A * | 1/1989 | Ochmann et al. | 378/108 |
| 5,517,545 | A * | 5/1996 | Nakamura et al. | 378/101 |
| 6,587,812 | B1 | 7/2003 | Takayama | |
| 2004/0109537 | A1 * | 6/2004 | Nakamura et al. | 378/111 |
| 2004/0247080 | A1 * | 12/2004 | Feda | 378/101 |

FOREIGN PATENT DOCUMENTS

| | | | |
|---|---|---|---|
| JP | 61-218100 | A | 9/1986 |
| JP | 2-5398 | A | 1/1990 |
| JP | 4-87299 | A | 3/1992 |
| JP | 6-13195 | A | 1/1994 |

(Continued)

*Primary Examiner*—Edward J. Glick
*Assistant Examiner*—Anastasia S. Midkiff
(74) *Attorney, Agent, or Firm*—Drinker Biddle & Reath LLP

(57) ABSTRACT

A maximum tube voltage value setting module 240*a*, a warming-up module 240*b*, a limit tube voltage control module 240*c*, a limit tube current control module 240*d* and a focus grid electrode control module 240*e* of an operation program 240 which respectively correspond to different maximum tube voltage values are stored in storage sections 32*a-e* of an X-ray tube control apparatus 3. When the maximum tube voltage value of an X-ray tube 1 is changed, an extraction section 34 extracts each module of the operation program 240 which corresponds to the maximum tube voltage value after being changed from the storage sections 32*a-e*. A communications section 36 sends the operation program 240 comprised of each extracted module to an X-ray tube controller 2 and overwrites it in a memory section 24.

18 Claims, 9 Drawing Sheets

FOREIGN PATENT DOCUMENTS

| | | | |
|---|---|---|---|
| JP | 6-318500 | A | 11/1994 |
| JP | 08-299317 | A | 11/1996 |
| JP | 63-95200 | U | 6/1998 |
| JP | 11-015520 | A | 1/1999 |
| JP | 2000-210800 | A | 8/2000 |
| JP | 2000-252094 | A | 9/2000 |

* cited by examiner

*Fig.4*

| MAXIMUM TUBE VOLTAGE VALUE | STORAGE SECTION 32a | STORAGE SECTION 32b | STORAGE SECTION 32c | STORAGE SECTION 32d | STORAGE SECTION 32e |
|---|---|---|---|---|---|
| 130kV | MAXIMUM TUBE VOLTAGE VALUE SETTING MODULE (130 kV) | WARMING-UP MODULE (FOR 130 kV) | LIMIT TUBE VOLTAGE CONTROL MODULE (150 kV) | LIMIT TUBE CURRENT CONTROL MODULE (360 μA) | FOCUS GRID ELECTRODE CONTROL MODULE ($V_{130}$[V]) |
| 120kV | MAXIMUM TUBE VOLTAGE VALUE SETTING MODULE (120 kV) | WARMING-UP MODULE (FOR 120 kV) | LIMIT TUBE VOLTAGE CONTROL MODULE (140 kV) | LIMIT TUBE CURRENT CONTROL MODULE (300 μA) | FOCUS GRID ELECTRODE CONTROL MODULE ($V_{120}$[V]) |
| 110kV | MAXIMUM TUBE VOLTAGE VALUE SETTING MODULE (110 kV) | WARMING-UP MODULE (FOR 110 kV) | LIMIT TUBE VOLTAGE CONTROL MODULE (135 kV) | LIMIT TUBE CURRENT CONTROL MODULE (270 μA) | FOCUS GRID ELECTRODE CONTROL MODULE ($V_{110}$[V]) |
| 100kV | MAXIMUM TUBE VOLTAGE VALUE SETTING MODULE (100 kV) | WARMING-UP MODULE (FOR 100 kV) | LIMIT TUBE VOLTAGE CONTROL MODULE (130 kV) | LIMIT TUBE CURRENT CONTROL MODULE (240 μA) | FOCUS GRID ELECTRODE CONTROL MODULE ($V_{100}$[V]) |
| ⋮ | ⋮ | ⋮ | ⋮ | ⋮ | ⋮ |

*Fig.5*

240

| MAXIMUM TUBE VOLTAGE: 130 kV/MAXIMUM TUBE CURRENT: 300 μA | | | | | |
|---|---|---|---|---|---|
| LIMIT TUBE VOLTAGE: 150 kV | | | | | |
| LIMIT TUBE CURRENT: 360 μA | | | | | |
| FOCUS GRID VOLTAGE: $V_{130}$[V] | | | | | |
| STEP | TUBE VOLTAGE (kV) | TUBE CURRENT (μA) | WARMING-UP TIME (min) | | |
| | | | 8 HOURS TO ONE MONTH AFTER OFF | ONE MONTH TO THREE MONTHS AFTER OFF | THREE MONTHS OR MORE AFTER OFF |
| 1 | 27 | 0 | 1 | 5 | 10 |
| 2 | 54 | 30 | 1 | 5 | 30 |
| 3 | 81 | 90 | 3 | 6 | 20 |
| 4 | 108 | 150 | 3 | 7 | 30 |
| 5 | 121 | 220 | 3 | 7 | 20 |
| 6 | 130 | 300 | 4 | 10 | 10 |
| | | | TOTAL 15(min) | TOTAL 40(min) | TOTAL 120(min) |

*Fig.6*

240

| MAXIMUM TUBE VOLTAGE: 100 kV/MAXIMUM TUBE CURRENT: 200 μA | | | | | |
|---|---|---|---|---|---|
| LIMIT TUBE VOLTAGE: 130 kV | | | | | |
| LIMIT TUBE CURRENT: 240 μA | | | | | |
| FOCUS GRID VOLTAGE: $V_{100}$[V] | | | | | |
| STEP | TUBE VOLTAGE (kV) | TUBE CURRENT (μA) | WARMING-UP TIME (min) | | |
| | | | 8 HOURS TO ONE MONTH AFTER OFF | ONE MONTH TO THREE MONTHS AFTER OFF | THREE MONTHS OR MORE AFTER OFF |
| 1 | 20 | 0 | 1 | 4 | 10 |
| 2 | 40 | 20 | 1 | 4 | 30 |
| 3 | 62 | 60 | 2 | 5 | 20 |
| 4 | 83 | 100 | 2 | 5 | 30 |
| 5 | 93 | 150 | 3 | 6 | 20 |
| 6 | 100 | 200 | 3 | 8 | 10 |
| | | | TOTAL 12(min) | TOTAL 32(min) | TOTAL 120(min) |

*Fig.7*

240

| MAXIMUM TUBE VOLTAGE: 110 kV/MAXIMUM TUBE CURRENT: 200 μA | | | | | |
|---|---|---|---|---|---|
| LIMIT TUBE VOLTAGE: 135 kV | | | | | |
| LIMIT TUBE CURRENT: 270 μA | | | | | |
| FOCUS GRID VOLTAGE: $V_{110}$[V] | | | | | |
| STEP | TUBE VOLTAGE (kV) | TUBE CURRENT (μA) | WARMING-UP TIME (min) | | |
| | | | 8 HOURS TO ONE MONTH AFTER OFF | ONE MONTH TO THREE MONTHS AFTER OFF | THREE MONTHS OR MORE AFTER OFF |
| 1 | 20 | 0 | 1 | 4 | 10 |
| 2 | 40 | 20 | 1 | 4 | 30 |
| 3 | 65 | 60 | 2 | 5 | 20 |
| 4 | 90 | 100 | 2 | 5 | 30 |
| 5 | 100 | 150 | 3 | 6 | 20 |
| 6 | 110 | 200 | 3 | 8 | 10 |
| | | | TOTAL 12(min) | TOTAL 32(min) | TOTAL 120(min) |

X-RAY TUBE CONTROL APPARATUS AND X-RAY TUBE CONTROL METHOD

TECHNICAL FIELD

The present invention relates to an X-ray tube control apparatus and an X-ray tube control method.

BACKGROUND ART

At the time an X-ray tube unit is shipped, a warming-up program for optimally warming up an X-ray tube under the set maximum tube voltage value, etc., are installed. Conventionally, even when the maximum tube voltage value of the X-ray tube was changed, the X-ray tube was operated without rewriting the warming-up program, etc., initially installed.

DISCLOSURE OF THE INVENTION

However, the conventional method has a problem that when the maximum tube voltage value of an X-ray tube is changed, the X-ray tube does not operate optimally.

The invention has been made to overcome the problem, and aims at providing an X-ray tube control method, etc., which allow an X-ray tube to operate optimally even when the maximum tube voltage value of the X-ray tube is changed.

To achieve the object, an X-ray tube control apparatus of the invention remotely controls an X-ray tube, and is characterized by having first storage means which stores a plurality of warming-up programs for respectively increasing a tube voltage and a tube current of the X-ray tube to a maximum tube voltage value and a maximum tube current value corresponding thereto according to a process corresponding to a downtime during which the X-ray tube has not operated, according to the maximum tube voltage value when the X-ray tube starts operating; first extraction means which extracts one from the plurality of warming-up programs stored in the first storage means which corresponds to the maximum tube voltage value after being changed at that time the maximum tube voltage value of the X-ray tube is changed; and first rewriting means which rewrites a warming-up program, stored in a memory section in a control apparatus that controls an operation of the X-ray tube, with the warming-up program extracted from the first extraction means via a telecommunications line. Another aspect of the X-ray tube control apparatus of the invention is characterized by having input means to which a maximum tube voltage value of an X-ray tube is input; storage means which stores a plurality of warming-up programs for respectively increasing a tube voltage and a tube current of the X-ray tube to a maximum tube voltage value and a maximum tube current value corresponding thereto according to a process corresponding to a downtime during which the X-ray tube has not operated, according to the maximum tube voltage value when the X-ray tube starts operating; extraction means which extracts one from the plurality of warming-up programs stored in the storage means which corresponds to the maximum tube voltage value input to the input means; and output means which outputs the warming-up program extracted by the extraction means.

An X-ray tube control method of the invention remotely controls an X-ray tube with an X-ray tube control apparatus, and is characterized by including storing a plurality of warming-up programs for respectively increasing a tube voltage and a tube current value of the X-ray tube to a maximum tube voltage value and a maximum tube current value corresponding thereto according to a process corresponding to a downtime during which the X-ray tube has not operated, in first storage means of the X-ray tube control apparatus beforehand according to the maximum tube voltage value when the X-ray tube starts operating; a first extraction step at which first extraction means of the X-ray tube control apparatus extracts one from the plurality of warming-up programs stored in the first storage means which corresponds to the maximum tube voltage value after being changed at that time the maximum tube voltage value of the X-ray tube is changed; and a first rewriting step at which first rewriting means of the X-ray tube control apparatus rewrites a warming-up program, stored in a memory section in a control apparatus that controls an operation of the X-ray tube, with the warming-up program extracted from the first extraction means via a telecommunications line. Another aspect of the X-ray tube control method of the invention is characterized by including storing a plurality of warming-up programs for respectively increasing a tube voltage and a tube current of an X-ray tube to a maximum tube voltage value and a maximum tube current value corresponding thereto according to a process corresponding to a downtime during which the X-ray tube has not operated, in storage means of an X-ray tube control apparatus beforehand according to the maximum tube voltage value when the X-ray tube starts operating; an input step at which the maximum tube voltage value of the X-ray tube is input to input means of the X-ray tube control apparatus; an extraction step at which extraction means of the X-ray tube control apparatus extracts one from the plurality of warming-up programs stored in the storage means which corresponds to the maximum tube voltage value input at the input step; and an output step at which output means of the X-ray tube control apparatus outputs the warming-up program extracted by the extraction means.

These can optimally warm up an X-ray tube when the maximum tube voltage value of the X-ray tube is changed.

To achieve the object, another aspect of the X-ray tube control apparatus of the invention is an X-ray tube control apparatus which remotely controls an X-ray tube, and is characterized by having second storage means which stores a plurality of limit tube voltage control programs for stopping application of a tube voltage with a limit tube voltage value corresponding to a maximum tube voltage value of the X-ray tube as a threshold, according to the maximum tube voltage value; second extraction means which extracts the limit tube voltage control program from the plurality of limit tube voltage control programs stored in the second storage means which sets a limit tube voltage value corresponding to the maximum tube voltage value after being changed as a threshold at that time the maximum tube voltage value of the X-ray tube is changed; and second rewriting means which rewrites a limit tube voltage control program, stored in a memory section in a control apparatus that controls an operation of the X-ray tube, with the limit tube voltage control program extracted from the second extraction means via a telecommunications line. Another aspect of the X-ray tube control apparatus of the invention is characterized by having input means to which a maximum tube voltage value of an X-ray tube is input; storage means which stores a plurality of limit tube voltage control programs for stopping application of a tube voltage with a limit tube voltage value corresponding to a maximum tube voltage value of the X-ray tube as a threshold, according to the maximum tube voltage value; extraction means which extracts one from the plurality of limit tube voltage control programs stored in the storage means which corresponds to the maximum tube voltage value input to the input means; and output means which outputs the limit tube voltage control program extracted by the extraction means.

Another aspect of the X-ray tube control method of the invention is an X-ray tube control method which remotely controls an X-ray tube with an X-ray tube control apparatus, and is characterized by including storing a plurality of limit tube voltage control programs for stopping application of a tube voltage with a limit tube voltage value corresponding to a maximum tube voltage value of the X-ray tube as a threshold, in second storage means of the X-ray tube control apparatus beforehand according to the maximum tube voltage value; a second extraction step at which second extraction means of the X-ray tube control apparatus extracts the limit tube voltage control program from the plurality of limit tube voltage control programs stored in the second storage means which sets a limit tube voltage value corresponding to the maximum tube voltage value after being changed as a threshold at that time the maximum tube voltage value of the X-ray tube is changed; and a second rewriting step at which second rewriting means of the X-ray tube control apparatus rewrites a limit tube voltage control program, stored in a memory section in a control apparatus that controls an operation of the X-ray tube, with the limit tube voltage control program extracted from the second extraction means via a telecommunications line. Another aspect of the X-ray tube control method of the invention is characterized by including storing a plurality of limit tube voltage control programs for stopping application of a tube voltage with a limit tube voltage value corresponding to a maximum tube voltage value of an X-ray tube as a threshold, in storage means of an X-ray tube control apparatus beforehand according to the maximum tube voltage value; an input step at which the maximum tube voltage value of the X-ray tube is input to input means of the X-ray tube control apparatus; an extraction step at which extraction means of the X-ray tube control apparatus extracts one from the plurality of limit tube voltage control programs stored in the storage means which corresponds to the maximum tube voltage value input at the input step; and an output step at which output means of the X-ray tube control apparatus outputs the limit tube voltage control program extracted by the extraction means.

These can adjust the limit tube voltage of an X-ray tube to an optimal value when the maximum tube voltage value of the X-ray tube is changed.

To achieve the object, another aspect of the X-ray tube control apparatus of the invention is an X-ray tube control apparatus which remotely controls an X-ray tube, and is characterized by having third storage means which stores a plurality of limit tube current control programs for stopping application of a tube voltage with a limit tube current value corresponding to a maximum tube voltage value of the X-ray tube as a threshold, according to the maximum tube voltage value; third extraction means which extracts the limit tube current control program from the plurality of limit tube current control programs stored in the third storage means which sets a limit tube current value corresponding to the maximum tube voltage value after being changed as a threshold at that time the maximum tube voltage value of the X-ray tube is changed; and third rewriting means which rewrites a limit tube current control program, stored in a memory section in a control apparatus that controls an operation of the X-ray tube, with the limit tube current control program extracted from the third extraction means via a telecommunications line. Another aspect of the X-ray tube control apparatus of the invention is characterized by-having input means to which a maximum tube voltage value of an X-ray tube is input; storage means which stores a plurality of limit tube current control programs for stopping application of a tube voltage with a limit tube current value corresponding to a maximum tube voltage value of the X-ray tube as a threshold, according to the maximum tube voltage value; extraction means which extracts one from the plurality of limit tube current control programs stored in the storage means which corresponds to the maximum tube voltage value input to the input means; and output means which outputs the limit tube current control program extracted by the extraction means.

Another aspect of the X-ray tube control method of the invention is an X-ray tube control method which remotely controls an X-ray tube with an X-ray tube control apparatus, and is characterized by including storing a plurality of limit tube current control programs for stopping application of a tube voltage with a limit tube current value corresponding to a maximum tube voltage value of the X-ray tube as a threshold, in third storage means of the X-ray tube control apparatus beforehand according to the maximum tube voltage value; a third extraction step at which third extraction means of the X-ray tube control apparatus extracts the limit tube current control program from the plurality of limit tube current control programs stored in the third storage means which sets a limit tube current value corresponding to the maximum tube voltage value after being changed as a threshold at that time the maximum tube voltage value of the X-ray tube is changed; and a third rewriting step at which third rewriting means of the X-ray tube control apparatus rewrites a limit tube current control program, stored in a memory section in a control apparatus that controls an operation of the X-ray tube, with the limit tube current control program extracted from the third extraction means via a telecommunications line. Another aspect of the X-ray tube control method of the invention is characterized by including storing a plurality of limit tube current control programs for stopping application of a tube voltage with a limit tube current value corresponding to a maximum tube voltage value of an X-ray tube as a threshold, in storage means of an X-ray tube control apparatus beforehand according to the maximum tube voltage value; an input step at which the maximum tube voltage value of the X-ray tube is input to input means of the X-ray tube control apparatus; an extraction step at which extraction means of the X-ray tube control apparatus extracts one from the plurality of limit tube current control programs stored in the storage means which corresponds to the maximum tube voltage value input at the input step; and an output step at which output means of the X-ray tube control apparatus outputs the limit tube current control program extracted by the extraction means.

These can adjust the limit tube current of an X-ray tube to an optimal value when the maximum tube voltage value of the X-ray tube is changed.

To achieve the object, another aspect of the X-ray tube control apparatus of the invention is an X-ray tube control apparatus which remotely controls an X-ray tube, and is characterized by having fourth storage means which stores a plurality of focus lens control programs for controlling a focus lens in such a way as to minimize a focal point when an electron beam hits a target of the X-ray tube with a maximum tube voltage applied to the target; fourth extraction means which extracts the focus lens control program from the plurality of focus lens control programs stored in the fourth storage means which corresponds to the maximum tube voltage value after being changed at that time the maximum tube voltage value of the X-ray tube is changed; and fourth rewriting means which rewrites a focus lens control program, stored in a memory section in a control apparatus that controls an operation of the X-ray tube, with the focus lens control program extracted from the fourth extraction means via a telecommunications line. Another aspect of the X-ray tube control apparatus of the invention is characterized by having input means to which a maximum tube voltage value of an X-ray tube is input; storage means which stores a plurality of focus lens control programs for controlling a focus lens in such a way as to minimize a focal point when an electron beam hits a target of the X-ray tube with a maximum tube voltage applied to the target; extraction means which extracts the focus lens control program from the plurality of focus lens control programs stored in the storage means which corresponds to the maximum tube voltage value input to the input means; and output means which outputs the focus lens control program extracted by the extraction means.

Another aspect of the X-ray tube control method of the invention is an X-ray tube control method which remotely controls an X-ray tube with an X-ray tube control apparatus, and is characterized by including storing a plurality of focus lens control programs for controlling a focus lens in fourth storage means of the X-ray tube control apparatus beforehand in such a way as to minimize a focal point when an electron beam hits a target of the X-ray tube with a maximum tube voltage applied to the target; a fourth extraction step at which fourth extraction means of the X-ray tube control apparatus extracts the focus lens control program from the plurality of focus lens control programs stored in the fourth storage means which corresponds to the maximum tube voltage value after being changed at that time the maximum tube voltage value of the X-ray tube is changed; and a fourth rewriting step at which fourth rewriting means of the X-ray tube control apparatus rewrites a focus lens control program, stored in a memory section in a control apparatus that controls an operation of the X-ray tube, with the focus lens control program extracted from the fourth extraction means via a telecommunications line. Another aspect of the X-ray tube control method of the invention is characterized by including storing a plurality of focus lens control programs for controlling a focus lens in storage means of an X-ray tube control apparatus beforehand in such a way as to minimize a focal point when an electron beam hits a target of an X-ray tube with a maximum tube voltage applied to the target; an input step at which the maximum tube voltage value of the X-ray tube is input to input means of the X-ray tube control apparatus; an extraction step at which extraction means of the X-ray tube control apparatus extracts the focus lens control program from the plurality of focus lens control programs stored in the storage means which corresponds to the maximum tube voltage value input at the input step; and an output step at which output means of the X-ray tube control apparatus outputs the focus lens control program extracted by the extraction means.

These can keep the minimization of the focal diameter even when the maximum tube voltage value of is the X-ray tube is changed.

BRIEF DESCRIPTION OF THE DRAWINGS

FIG. 4 is a diagram showing modules of the operation program 240 stored in storage sections 32*a-e*.

FIG. 5 is a diagram showing the operation program 240 when the maximum tube voltage is 130 kV.

FIG. 6 is a diagram showing the operation program 240 when the maximum tube voltage is 100 kV.

FIG. 7 is a diagram showing the operation program 240 when the maximum tube voltage is 110 kV.

BEST MODE FOR CARRYING OUT THE INVENTION

Preferred embodiments of an X-ray tube control apparatus and an X-ray tube control method according to the invention will be described in detail below with reference to the accompanying drawings.

FIRST EMBODIMENT

Figure 1:
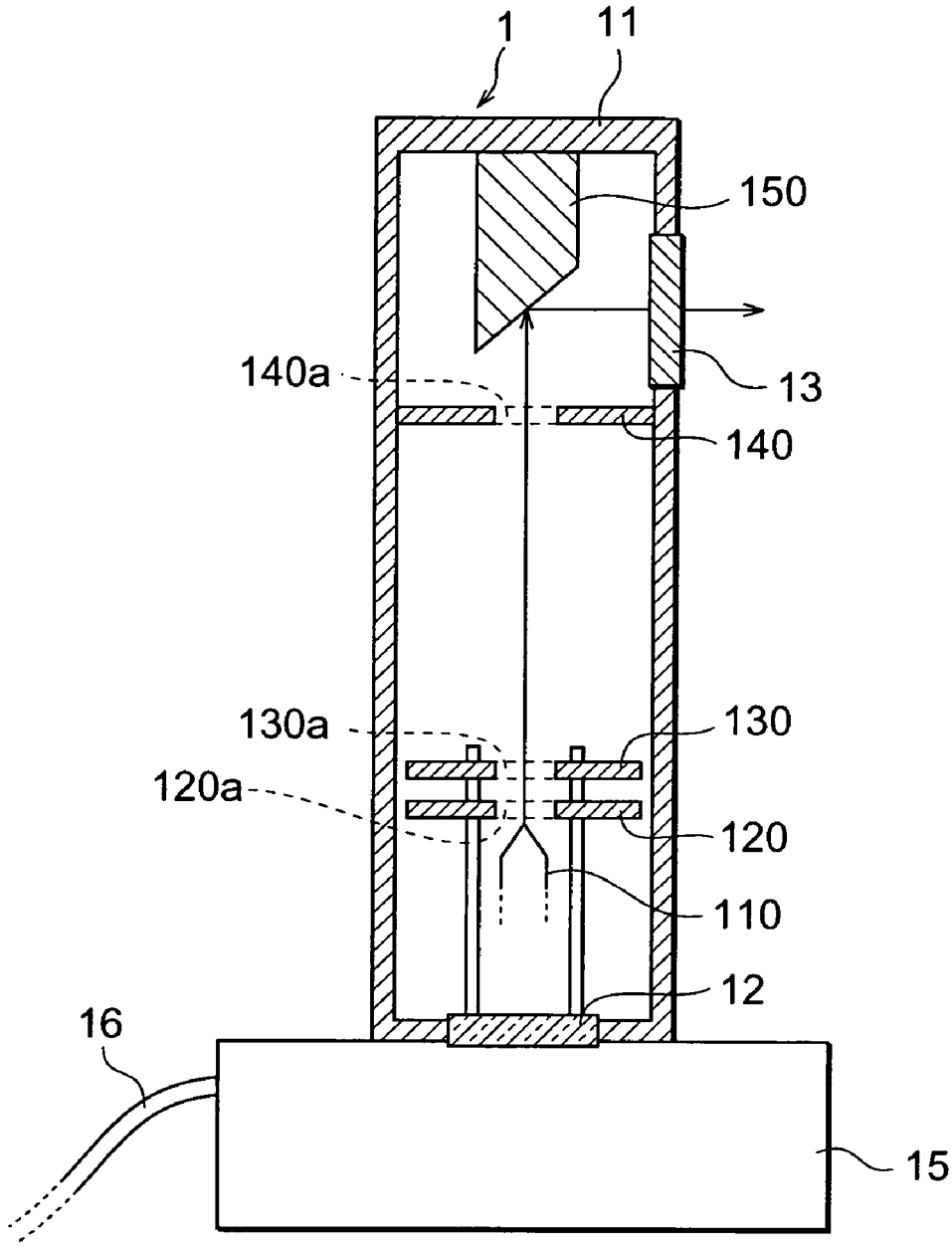
FIG. 1 is an exemplary diagram (cross-sectional view) showing the structure of an X-ray tube 1.

First, the structure and operation of an X-ray tube 1 which is managed by an X-ray tube control apparatus 3 according to the embodiment will be described. FIG. 1 is an exemplary diagram (cross-sectional view) showing the structure of the X-ray tube 1. As shown in FIG. 1, the X-ray tube 1 is sealed in vacuum by the outer casing comprised of a metal enclosure 11, which is kept at the ground potential, an insulator stem 12 and a beryllium window 13 which passes X-rays.

The X-ray tube 1 has a cathode 110 which emits thermions when heated by a heater, a first focus grid electrode 120 and a second grid electrode 130, which accelerate and converge the thermions, a third grid electrode 140 which is kept at the same potential (ground potential) as that of the metal enclosure 11, and a tungsten target 150 which generates X-rays when hit by the thermions. The first focus grid electrode 120 has a function of pushing the thermions back to the filament side when applied with a negative voltage. The second grid electrode 130 has a function of pulling the thermions toward the target side when applied with a positive voltage. The first focus grid electrode 120 and the second grid electrode 130, together with the third grid electrode 140, also have a function as an electrostatic lens (focus lens) to converge an electron beam. The first focus grid electrode 120, the second grid electrode 130 and the third grid electrode 140 are arranged in that order from the cathode 110 to the target 150, and the first focus grid electrode 120, the second grid electrode 130 and the third grid electrode 140 respectively have an opening 120*a*, an opening 130*a* and an opening 140*a* in their centers for passing the thermions.

The X-ray tube 1 has a power supply 15 including a high-voltage generating circuit for applying a positive high voltage to the target 150.

The X-ray tube 1 is controlled by an X-ray tube controller 2 connected to the X-ray tube 1 by a control cable 16.

When the main power supply of the X-ray tube 1 is on, the cathode 110 emits thermions as it is heated by a heater. The X-ray tube 1 starts warming up to increase the tube voltage to the maximum tube voltage value step by step and increase the tube current value to the maximum tube current value (the tube current value to minimize the focal diameter under the maximum tube voltage value) step by step. As warming-up ends, a negative cutoff voltage is applied to the first focus grid electrode 120, stopping the tube current.

When the X-ray irradiation switch of the X-ray is tube 1 is on, the voltage which is applied to the first focus grid electrode 120 rises from the cutoff voltage to an operation voltage, and the thermions emitted from the cathode 110 are pulled to the second grid electrode 130, which has a higher potential than the cathode 110 does, and pass through the opening 120*a* of the first focus grid electrode 120. Further, the thermions pass through the opening 130*a* of the second grid electrode 130 and the opening 140*a* of the third grid electrode 140 while being accelerated by the tube voltage applied to the target 150, and becomes an electron beam directing toward the target 150 applied with the positive high voltage. At the time of passing the opening 120*a*, the opening 130*a* and the opening 140*a*, the electron beam contracts its beam diameter by an electric field formed by the first to third grid electrodes, the cathode 110 and the target 150. When the electron beam which is converged by the electric field hits the target 150, the target 150 generates X-rays. The X-rays pass through the beryllium window 13 and exit the X-ray tube 1.

The focal diameter when an electron beam hits the target 150 varies according to the strength of the electrostatic lens or the tube voltage, and the voltage applied to the first focus grid electrode 120 and the voltage applied to the second grid electrode 130. The voltages applied to the first focus grid electrode 120 and the second grid electrode 130 are controlled in such a way that the focal diameter under the maximum tube voltage is minimized. The maximum tube current value is determined by the thus controlled voltage values of the first focus grid electrode 120 and the second grid electrode 130.

Figure 2:
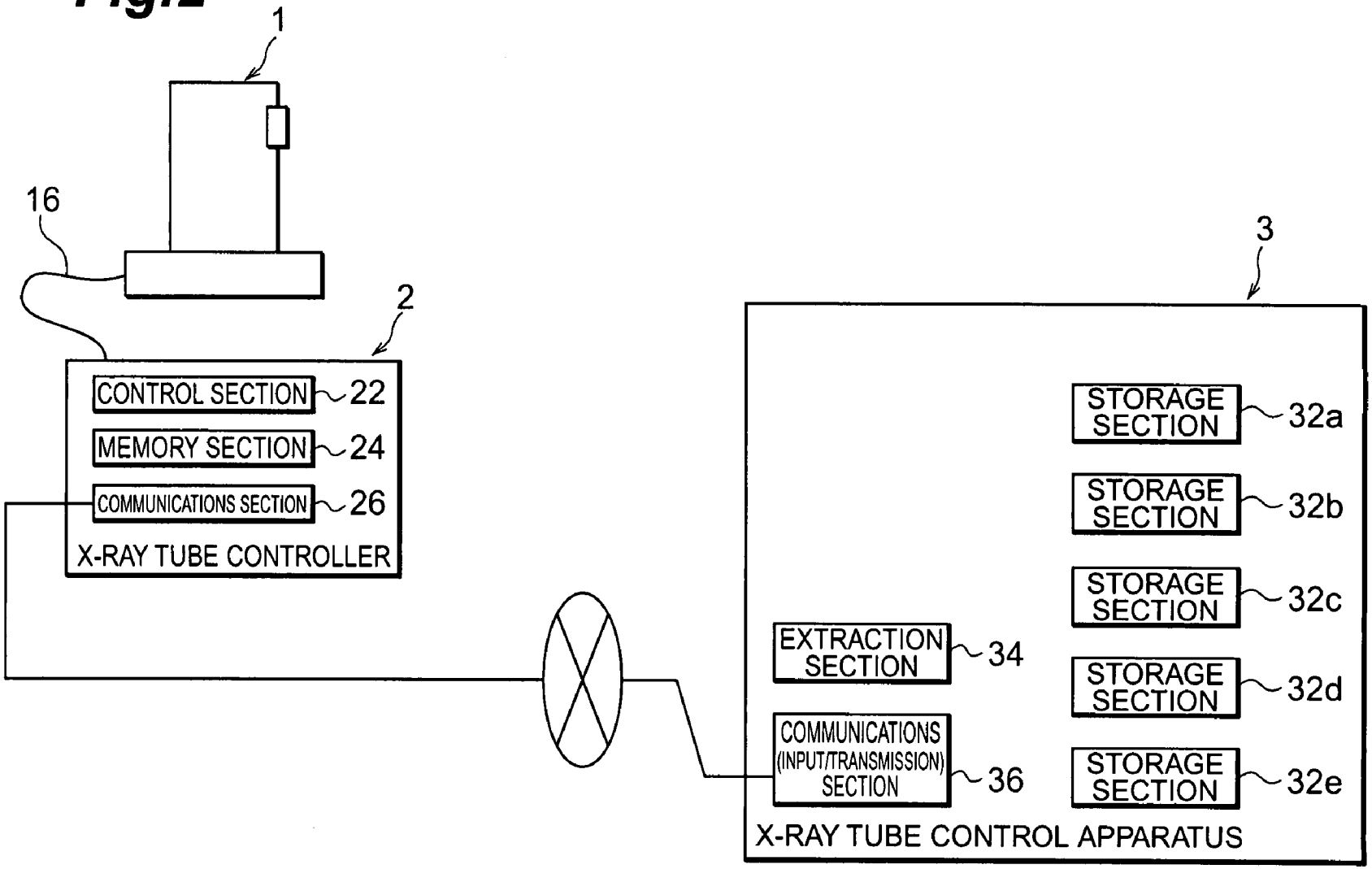
FIG. 2 is a diagram for explaining an X-ray tube management system according to a first embodiment.

Next, the functional structure of the X-ray tube management system to which the X-ray tube control apparatus 3 is adapted will be described. FIG. 2 is a diagram for explaining the X-ray tube management system to which the X-ray tube control apparatus 3 is adapted. As shown in FIG. 2, the X-ray tube management system has the X-ray tube 1, the X-ray tube controller 2 and the X-ray tube control apparatus 3. The X-ray tube 1 and the X-ray tube controller 2 are set at the place of a user while the X-ray tube control apparatus 3 is set at the place of a customer engineer for the X-ray tube, and both are connected via a telecommunications line such as the Internet.

The X-ray tube controller 2 has a control section 22, a memory section 24 and a communications section 26 which functions as a rewriting section. The control section 22 has functions of reading an operation program 240 stored in the memory section 24 and operating the individual sections of the X-ray tube 1 according to the operation program 240.

Figure 3:
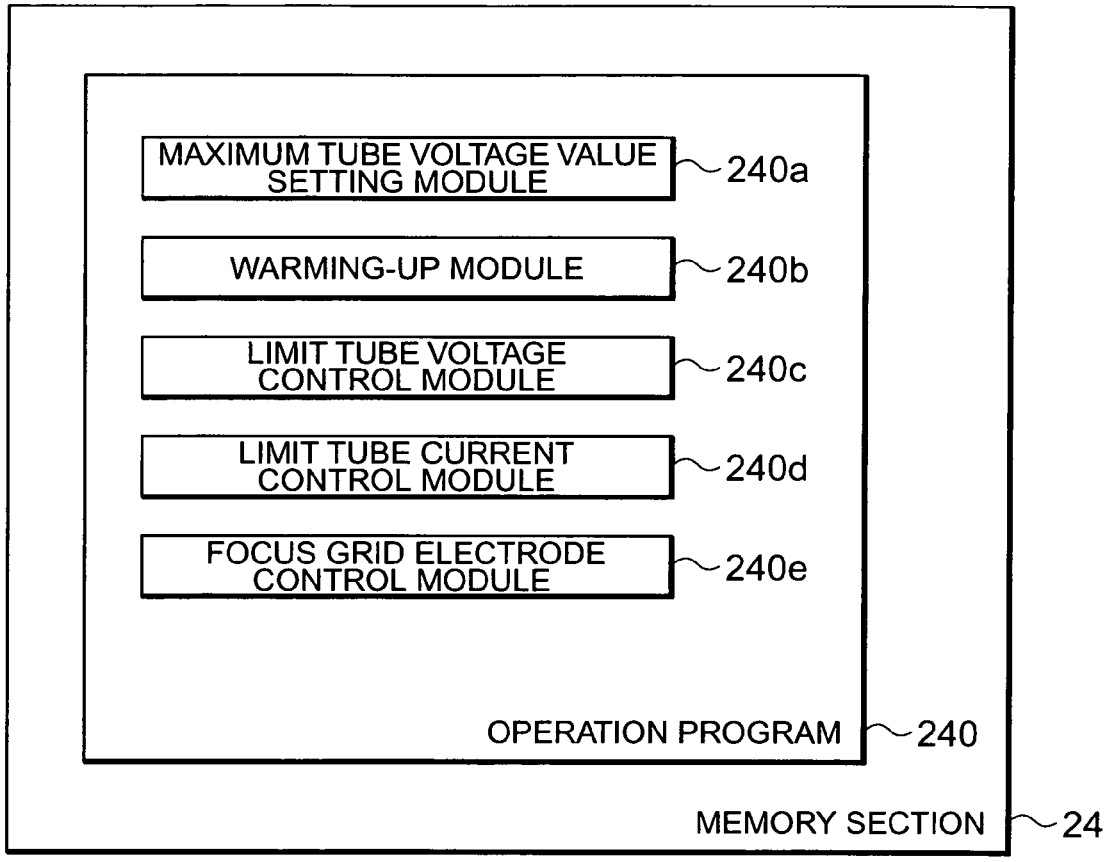
FIG. 3 is a structural diagram of an operation program 240 stored in a memory section 24.

The operation program 240 for the X-ray tube 1 is stored in the memory section 24. FIG. 3 is a structural diagram of the operation program 240 stored in the memory section 24. The operation program 240 includes a maximum tube voltage value setting module 240*a*, which sets the maximum tube voltage value of the X-ray tube 1 (that is set to 130 kV at the time of shipment of the X-ray tube 1), a warming-up module 240*b*, which warms up the X-ray tube 1 to the maximum tube voltage value, a limit tube voltage control module 240*c*, which stops application of the tube voltage, with the limit tube voltage value corresponding to the maximum tube voltage value of the X-ray tube 1 (the limit tube voltage value is set to a voltage value higher than the maximum tube voltage value by approximately 30 kV) being a threshold, a limit tube current control module 240*c*, which stops application of the tube voltage, with the limit tube current value corresponding to the maximum tube voltage value of the X-ray tube 1 (the limit tube current value is set to a current value higher than the maximum tube current value (the tube current value that minimizes the focal diameter under the maximum tube voltage value) by approximately 50 μA) being a threshold, and a focus grid electrode control module 240*e*, which controls the voltages to be applied to the first focus grid electrode 120 and the second grid electrode 130 in such a way as to minimize the focal diameter with the maximum tube voltage applied to the target 150.

The X-ray tube control apparatus 3 has storage sections 32*a-e*, an extraction section 34 and a communications section (input, transmission) 36. FIG. 4 is a diagram showing the modules of the operation program 240 stored in the storage sections 32*a-e*. The maximum tube voltage value setting module 240*a* (maximum tube voltage value: 130 kV, 120 kV, 110 kV, 100 kV, . . . ), which corresponds to the maximum tube voltage that becomes lower from 130 kV by 10 kV at that time, is stored in the storage section 32*a*. The warming-up module 240*b* (maximum tube voltage value: 130 kV, 120 kV, 110 kV, 100 kV, . . . ), which corresponds to the maximum tube voltage that becomes lower from 130 kV by 10 kV at that time, is stored in the storage section 32*b*. The limit tube voltage control module 240*c* (limit tube voltage value: 150 kV, 140 kV, 135 kV, 130 kV, . . . ), which corresponds to the maximum tube voltage that becomes lower from 130 kV by 10 kV at that time, is stored in the storage section 32*c*. The limit tube current control module 240*d* (limit tube current value: 360 μA, 300 μA, 270 μA, 240 μA, . . . ), which corresponds to the maximum tube voltage that becomes lower from 130 kV by 10 kV at that time, is stored in the storage section 32*d*. The focus grid electrode control module 240*e* (maximum tube voltage value: 130 kV, 120 kV, 110 kV, 100 kV, . . . ), which corresponds to the maximum tube voltage that becomes lower from 130 kV by 10 kV at that time, is stored in the storage section 32*e*.

The extraction section 34 has a function of extracting one corresponding to the changed maximum tube voltage value from the modules of the operation program 240 stored in the storage sections 32*a-e* when the maximum tube voltage value of the X-ray tube 1 is changed.

The communications section 36 has a function of sending the operation program 240, comprised of each module extracted by the extraction section 34, to the X-ray tube controller 2 and overwriting it in the memory section 24.

Next, a description will be given of the operation of the X-ray tube control apparatus 3 to rewrite the operation program 240 at the time the maximum tube voltage value of the X-ray tube 1 is changed.

A customer engineer changes the maximum tube voltage value of the X-ray tube 1 according to a request from a user by using the X-ray tube control apparatus. The extraction section 34 of the X-ray tube control apparatus extracts the maximum tube voltage value setting module 240*a* corresponding to the maximum tube voltage value to be changed from the storage section 32*a*. At the same time, the extraction section 34 extracts the warming-up module 240*b*, the limit tube voltage control module 240*c*, the limit tube current control module 240*d* and the focus grid electrode control module 240*e* which correspond to the maximum tube voltage value to be changed from the storage sections 32*b-e*, respectively.

The communications section 36 sends the operation program 240, comprised of the maximum tube voltage value setting module 240*a*, the warming-up module 240*b*, the limit tube voltage control module 240*c*, the limit tube current control module 240*d* and the focus grid electrode control module 240*e* extracted by the extraction section 34, to the X-ray tube controller 2 via the telecommunications line, and overwrites the operation program 240 stored in the memory section 24 with it.

FIG. 5 shows the operation program 240 when the maximum tube voltage is 130 kV. FIG. 6 shows the operation program 240 when the maximum tube voltage is 100 kV. FIG. 7 shows the operation program 240 when the maximum tube voltage is 110 kV. When the maximum tube voltage value set to 130 kV is changed to 100 kV, for example, the operation program 240 in the X-ray tube controller 2 is rewritten with the one shown in FIG. 6.

Under the changed operation program 240, the tube voltage and the tube current respectively rise to 100 kV and 200 μA step by step according to steps 1 to 6 shown in FIG. 6 when the main power supply of the X-ray tube 1 is turned on. The timer of the X-ray tube controller 2 measures measuring the time since the main power supply of the X-ray tube 1 is turned off (downtime). The process in which the tube voltage and the tube current rise is determined according to the downtime. When the downtime is two months, for example, the tube voltage and the tube current respectively rise to 100 KV and 200 μA through the process in which the state of the tube voltage of 20 kV and the tube current of 0 μA continues for four minutes (step 1), the state of the tube voltage of 40 kV and the tube current of 20 μA continues for four minutes (step 2), the state of the tube voltage of 62 kV and the tube current of 60 μA continues for five minutes (step 3), the state of the tube voltage of 83 kV and the tube current of 100 μA continues for five minutes (step 4), the state of the tube voltage of 93 kV and the tube current of 150 μA continues for six minutes (step 5), and the state of the tube voltage of 100 kV and the tube current of 200 μA continues for eight minutes (step 6). As such a warming-up process is changed, the time needed for warming-up can be shortened to the minimum required time of 32 minutes.

The limit tube voltage value is changed to 130 kV from 150 kV, the limit tube current value is changed to 240 μA from 360 μA, and the focus grid voltage value (the value of the voltage applied to the focus grid electrode) is changed to $V_{100}$ [V] (the grid voltage value to minimize the focal diameter when the tube voltage is 100 kV) from $V_{130}$ [V] (the grid voltage value to minimize the focal diameter when the tube voltage is 130 kV). Making those changes causes the X-ray tube 1 to operate more securely, and keeps the minimization of the focal diameter.

In a case where the maximum tube voltage value on the programs which matches with the maximum tube voltage value after the change, such as a case where the maximum tube voltage value is changed to 105 kV, for example, a warming-up program is extracted in such a way that the maximum tube voltage value on the programs becomes larger than the maximum tube voltage value after the change and the difference between the maximum tube voltage value on the programs and the maximum tube voltage value after the change becomes minimum. That is, when the maximum tube voltage value is changed to 105 kV, the warming-up program that corresponds to the maximum tube voltage value of 110 kV (see FIG. 7) is extracted, and installed in the X-ray tube controller 2. Execution of such extraction ensures sufficient warming-up.

When there is no maximum tube voltage value on the programs which matches with the maximum tube voltage value after being changed, the X-ray tube control apparatus 3 may rewrite to the warming-up module 240*b* which has computed the appropriate warming-up process. When the maximum tube voltage value is changed to 105 kV, for example, the tube voltage value at step 1 may be set to 20 kV, the tube voltage value at step 2 may be set to 40 kV, the tube voltage value at step 3 may be set to 63.5 kV, the tube voltage value at step 4 may be set to 86.5 kV, the tube voltage value at step 5 may be set to 96.5 kV, and the tube voltage value at step 6 may be set to 105 kV.

With regard to the limit tube voltage value, the limit tube current value and the focus grid voltage value, when there is no maximum tube voltage value on the programs which matches with the maximum tube voltage value after being changed, the limit tube voltage control module 240*c*, the limit tube current control module 240*d* and the focus grid electrode control module 240*e* are extracted in such a way that the maximum tube voltage value on the programs becomes larger than the maximum tube voltage value after the change and the difference between the maximum tube voltage value on the programs and the maximum tube voltage value after the change becomes minimum, or the limit tube voltage control module 240*c*, the limit tube current control module 240*d* and the focus grid electrode control module 240*e* which have computed the appropriate limit tube voltage value, limit tube current value and focus grid voltage value can be rewritten to.

SECOND EMBODIMENT

Figure 8:
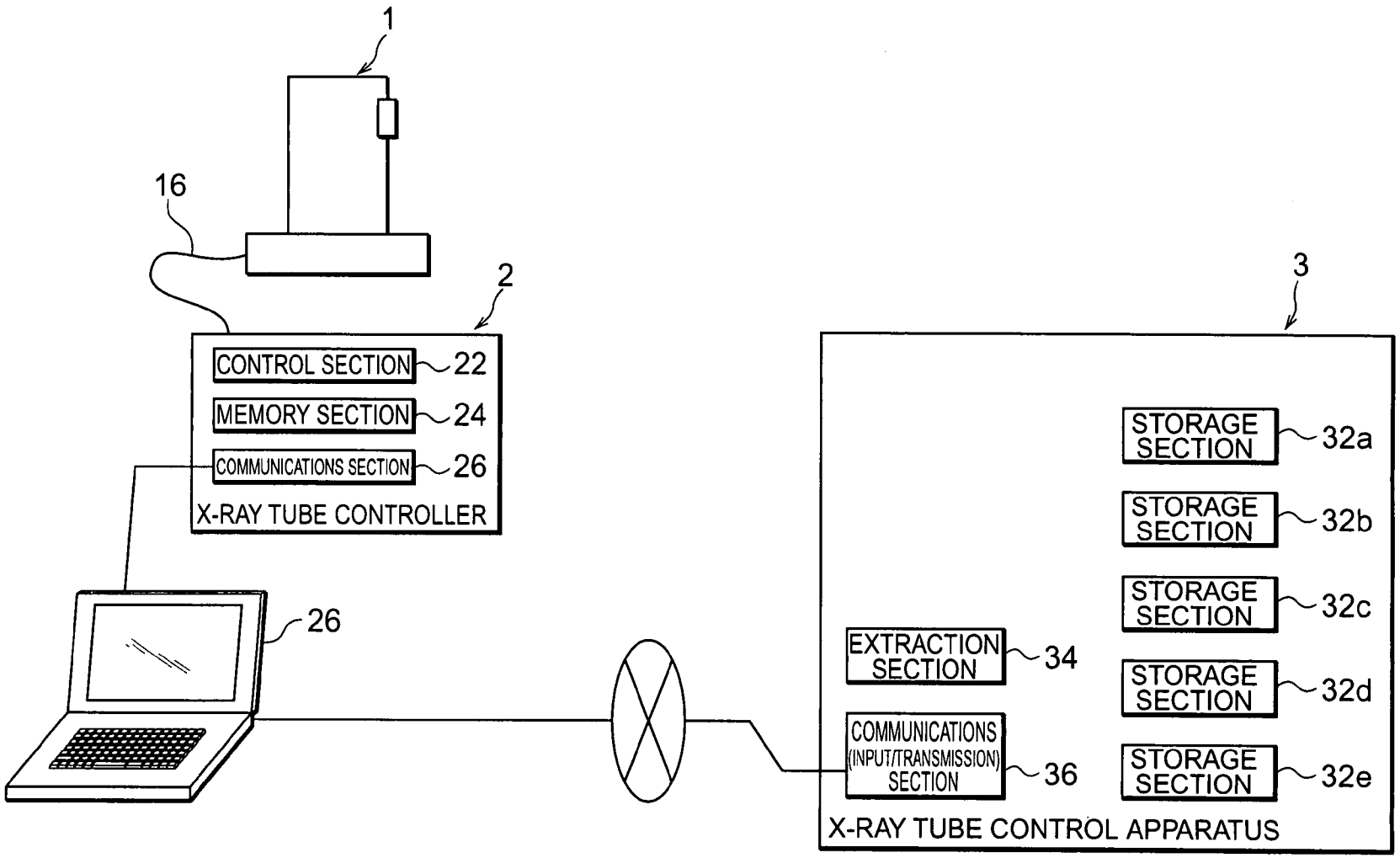
FIG. 8 is a diagram for explaining an X-ray tube management system according to a second embodiment.

FIG. 8 is a diagram for explaining an X-ray tube management system according to the second embodiment. In the second embodiment, the communications section 36 functions as input means to which the maximum tube voltage value after being changed is input, and a transmission section which sends the operation program 240 corresponding to the maximum tube voltage value after being changed to a notebook personal computer 4. The X-ray tube control apparatus 3 functions in the same way as that of the first embodiment in the other points.

Figure 9:
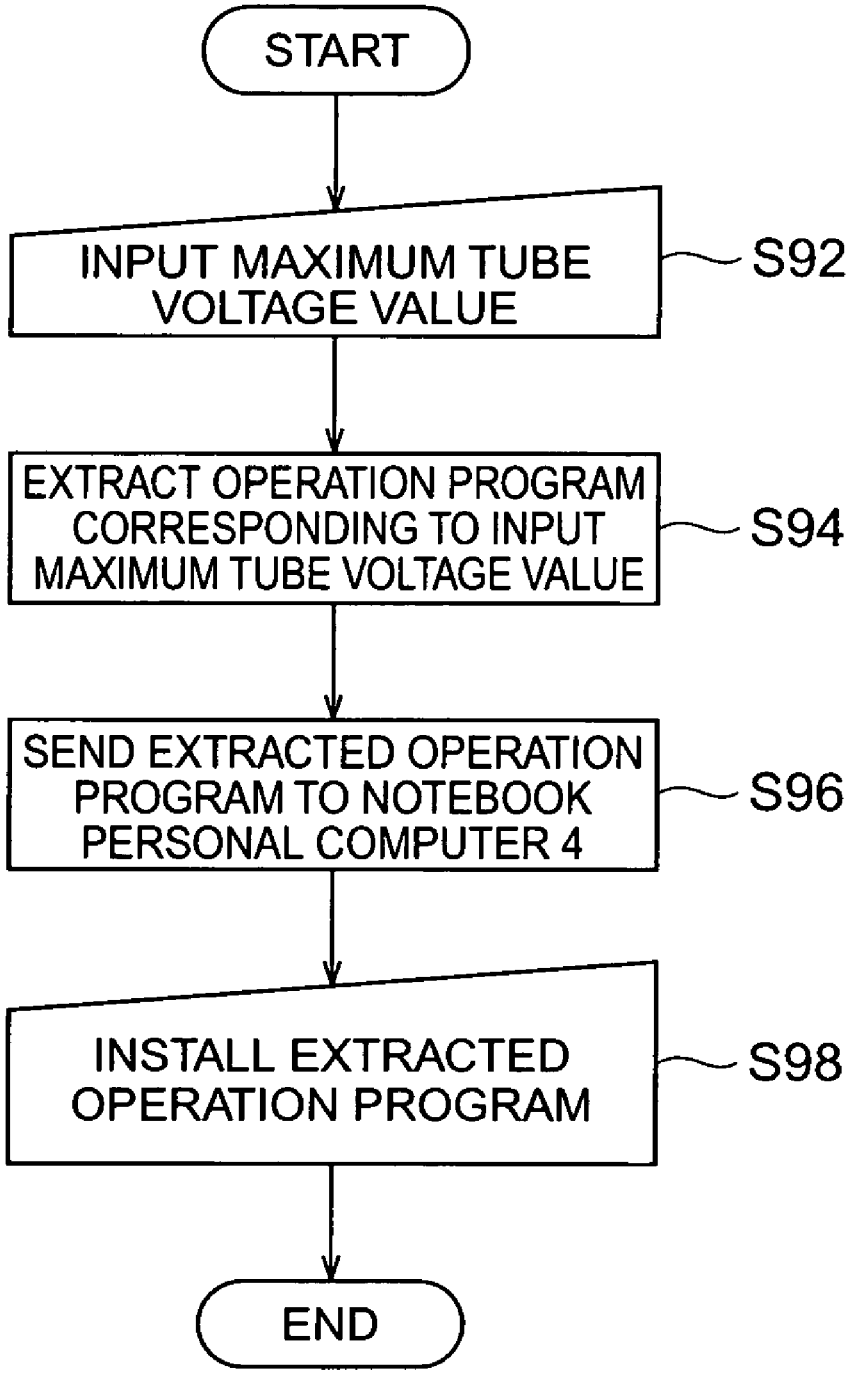
FIG. 9 is a flowchart illustrating procedures of the operation of the X-ray tube management system of the second embodiment.

In the second embodiment, a customer engineer who carries the notebook personal computer 4 goes to the place of a user of the X-ray tube 1 and rewrites the operation program 240. FIG. 9 is a flowchart illustrating procedures of the operation of the X-ray tube management system of the second embodiment. Referring to FIG. 9, the procedures of rewriting the operation program 240 in the second embodiment will be described.

When the customer engineer receives a user's request of changing the maximum tube voltage, a customer engineer carrying the notebook personal computer 4 goes to the place of the user. The customer engineer connects the notebook personal computer 4 to the X-ray tube control apparatus 3 via a telecommunications line at the place of the user, then inputs the maximum tube voltage after being changed to the communications section 36 (S92).

The operation program 240 corresponding to the input maximum tube voltage value is extracted as per the first embodiment (S94).

The communications section 36 sends the operation program 240 extracted at S94 to the notebook personal computer 4 (S96).

The customer engineer connects the notebook personal computer 4 to the X-ray tube controller 2, then writes the operation program 240 sent at S96 in the memory section 24 of the X-ray tube controller 2 (S98).

INDUSTRIAL APPLICABILITY

The X-ray tube control apparatus and the X-ray tube control method according to the invention can be adapted to control, for example, medical X-ray generating equipment.

The invention claimed is:

1. An X-ray tube control apparatus which remotely controls an X-ray tube, comprising:

first storage means which stores a plurality of warming-up programs for respectively increasing a tube voltage and a tube current of said X-ray tube to a maximum tube voltage value and a maximum tube current value corresponding thereto according to a process corresponding to a downtime during which said X-ray tube has not operated when said X-ray tube starts operating, according to the maximum tube voltage values;

first extraction means which extracts one from said plurality of warming-up programs stored in said first storage means which corresponds to the maximum tube voltage value after being changed at that time the maximum tube voltage value of said X-ray tube is changed; and first rewriting means which rewrites a warming-up program, stored in a memory section in a control apparatus that controls an operation of said X-ray tube, with said warming-up program extracted by said first extraction means via a telecommunications line.

2. An X-ray tube control apparatus which remotely controls an X-ray tube, comprising:

storage means which stores a plurality of limit tube voltage control programs for stopping application of a tube voltage with a limit tube voltage value corresponding to a maximum tube voltage value of said X-ray tube as a threshold, according to the maximum tube voltage values;

extraction means which extracts said limit tube voltage control program from said plurality of limit tube voltage control programs stored in said storage means which sets a limit tube voltage value corresponding to the maximum tube voltage value after being changed as a threshold at that time the maximum tube voltage value of said X-ray tube is changed; and rewriting means which rewrites a limit tube voltage control program, stored in a memory section in a control apparatus that controls an operation of said X-ray tube, with said limit tube voltage control program extracted by said extraction means via a telecommunications line.

3. An X-ray tube control apparatus which remotely controls an X-ray tube, comprising:

storage means which stores a plurality of limit tube current control programs for stopping application of a tube voltage with a limit tube current value corresponding to a maximum tube voltage value of said X-ray tube as a threshold, according to the maximum tube voltage values;

extraction means which extracts said limit tube current control program from said plurality of limit tube current control programs stored in said storage means which sets a limit tube current value corresponding to the maximum tube voltage value after being changed as a threshold at that time the maximum tube voltage value of said X-ray tube is changed; and rewriting means which rewrites a limit tube current control program, stored in a memory section in a control apparatus that controls an operation of said X-ray tube, with said limit tube current control program extracted by said extraction means via a telecommunications line.

4. An X-ray tube control apparatus which remotely controls an X-ray tube, comprising:

storage means which stores a plurality of focus lens control programs for controlling a focus lens in such a way as to minimize a focal point when an electron beam hits a target of said X-ray tube with a maximum tube voltage applied to the target, according to the maximum tube voltage values;

extraction means which extracts said focus lens control program from said plurality of focus lens control programs stored in said storage means which corresponds to the maximum tube voltage value after being changed at that time the maximum tube voltage value of said X-ray tube is changed; and rewriting means which rewrites a focus lens control program, stored in a memory section in a control apparatus that controls an operation of said X-ray tube, with said focus lens control program extracted by said extraction means via a telecommunications line.

5. An X-ray tube control method which remotely controls an X-ray tube with an X-ray tube control apparatus, wherein a plurality of warming-up programs for respectively increasing a tube voltage and a tube current value of said X-ray tube to a maximum tube voltage value and a maximum tube current value corresponding thereto according to a process corresponding to a downtime during which said X-ray tube has not operated when said X-ray tube starts operating are stored in first storage means of said X-ray tube control apparatus beforehand according to the maximum tube voltage values, and comprising:

a first extraction step at which first extraction means of said X-ray tube control apparatus extracts one from said plurality of warming-up programs stored in said first storage means which corresponds to the maximum tube voltage value after being changed at that time the maximum tube voltage value of said X-ray tube is changed; and a first rewriting step at which first rewriting means of said X-ray tube control apparatus rewrites a warming-up program, stored in a memory section in a control apparatus that controls an operation of said X-ray tube, with said warming-up program extracted by said first extraction means via a telecommunications line.

6. An X-ray tube control method which remotely controls an X-ray tube with an X-ray tube control apparatus, wherein a plurality of limit tube voltage control programs for stopping application of a tube voltage with a limit tube voltage value corresponding to a maximum tube voltage value of said X-ray tube as a threshold are stored in second storage means of said X-ray tube control apparatus beforehand according to the maximum tube voltage values, and comprising:

an extraction step at which an extraction means of said X-ray tube control apparatus extracts said limit tube voltage control program from said plurality of limit tube voltage control programs stored in said storage means which sets a limit tube voltage value corresponding to the maximum tube voltage value after being changed as a threshold at that time the maximum tube voltage value of said X-ray tube is changed; and a rewriting step at which a rewriting means of said X-ray tube control apparatus rewrites a limit tube voltage control program, stored in a memory section in a control apparatus that controls an operation of said X-ray tube, with said limit tube voltage control program extracted by said extraction means via a telecommunications line.

7. An X-ray tube control method which remotely controls an X-ray tube with an X-ray tube control apparatus, wherein a plurality of limit tube current control programs for stopping application of a tube voltage with a limit tube current value corresponding to a maximum tube voltage value of said X-ray tube as a threshold are stored in a storage means of said X-ray tube control apparatus beforehand according to the maximum tube voltage values, and comprising:

an extraction step at which extraction means of said X-ray tube control apparatus extracts said limit tube current control program from said plurality of limit tube current control programs stored in said storage means which sets a limit tube current value corresponding to the maximum tube voltage value after being changed as a threshold at that time the maximum tube voltage value of said X-ray tube is changed; and a rewriting step at which a rewriting means of said X-ray tube control apparatus rewrites a limit tube current control program, stored in a memory section in a control apparatus that controls an operation of said X-ray tube, with said limit tube current control program extracted by said extraction means via a telecommunications line.

8. An X-ray tube control method which remotely controls an X-ray tube with an X-ray tube control apparatus, wherein a plurality of focus lens control programs for controlling a focus lens in such a way as to minimize a focal point when an electron beam hits a target of said X-ray tube with a maximum tube voltage applied to the target are stored in a storage means of said X-ray tube control apparatus according to the maximum tube voltage value beforehand, and comprising:

an extraction step at which an extraction means of said X-ray tube control apparatus extracts said focus lens control program from said plurality of focus lens control programs stored in said storage means which corresponds to the maximum tube voltage value after being changed at that time the maximum tube voltage value of said X-ray tube is changed; and a rewriting step at which a rewriting means of said X-ray tube control apparatus rewrites a focus lens control program, stored in a memory section in a control apparatus that controls an operation of said X-ray tube, with said focus lens control program extracted by said extraction means via a telecommunications line.

9. An X-ray tube control apparatus comprising:

input means to which a maximum tube voltage value of an X-ray tube is input;

storage means which stores a plurality of warming-up programs for respectively increasing a tube voltage and a tube current of said X-ray tube to a maximum tube voltage value and a maximum tube current value corresponding thereto according to a process corresponding to a downtime during which said X-ray tube has not operated when said X-ray tube starts operating, according to the maximum tube voltage values;

extraction means which extracts one from said plurality of warming-up programs stored in said storage means which corresponds to the maximum tube voltage value input to said input means; and output means which outputs said warming-up program extracted by said extraction means.

10. An X-ray tube control apparatus according to claim 9, further comprising:

storage means which stores a plurality of limit tube voltage control programs for stopping application of a tube voltage with a limit tube voltage value corresponding to a maximum tube voltage value of said X-ray tube as a threshold, according to the maximum tube voltage values;

extraction means which extracts one from said plurality of limit tube voltage control programs stored in said storage means which corresponds to the maximum tube voltage value input to said input means; and output means which outputs said limit tube voltage control program extracted by said extraction means.

11. An X-ray tube control apparatus according to claim 9, further comprising:

storage means which stores a plurality of limit tube current control programs for stopping application of a tube voltage with a limit tube current value corresponding to a maximum tube voltage value of said X-ray tube as a threshold, according to the maximum tube voltage values;

extraction means which extracts one from said plurality of limit tube current control programs stored in said storage means which corresponds to the maximum tube voltage value input to said input means; and output means which outputs said limit tube current control program extracted by said extraction means.

12. An X-ray tube control apparatus according to claim 9, further comprising:

storage means which stores a plurality of focus lens control programs for controlling a focus lens in such a way as to minimize a focal point when an electron beam hits a target of said X-ray tube with a maximum tube voltage applied to the target, according to the maximum tube voltage values;

extraction means which extracts said focus lens control program from said plurality of focus lens control programs stored in said storage means which corresponds to the maximum tube voltage value input to said input means; and output means which outputs said focus lens control program extracted by said extraction means.

13. The X-ray tube control apparatus according to claim 9, wherein when there is no maximum tube voltage value on the warming-up programs which matches with the maximum tube voltage value input to said input means, the maximum tube voltage value input to said input means is associated with the warming-up programs stored in said storage means in such a way that the maximum tube voltage value on the warming-up program is greater than the maximum tube voltage value input to said input means and a difference between the maximum tube voltage value on the warming-up program and the maximum tube voltage value input to said input means becomes minimum.

14. An X-ray tube control method, wherein a plurality of warming-up programs for respectively increasing a tube voltage and a tube current of an X-ray tube to a maximum tube voltage value and a maximum tube current value corresponding thereto according to a process corresponding to a downtime during which said X-ray tube has not operated when said X-ray tube starts operating are stored in storage means of an X-ray tube control apparatus beforehand according to the maximum tube voltage values, and comprising:

an input step at which the maximum tube voltage value of said X-ray tube is input to input means of said X-ray tube control apparatus;

an extraction step at which extraction means of said X-ray tube control apparatus extracts one from said plurality of warming-up programs stored in said storage means which corresponds to the maximum tube voltage value input at said input step; and an output step at which output means of said X-ray tube control apparatus outputs said warming-up program extracted by said extraction means.

15. An X-ray tube control method according to claim 14, wherein a plurality of limit tube voltage control programs for stopping application of a tube voltage with a limit tube voltage value corresponding to a maximum tube voltage value of an X-ray tube as a threshold are stored in storage means of an X-ray tube control apparatus beforehand according to the maximum tube voltage values, and further comprising:

an extraction step at which extraction means of said X-ray tube control apparatus extracts one from said plurality of limit tube voltage control programs stored in said storage means which corresponds to the maximum tube voltage value input at said input step; and an output step at which output means of said X-ray tube control apparatus outputs said limit tube voltage control program extracted by said extraction means.

16. An X-ray tube control method according to claim 14, wherein a plurality of limit tube current control programs for stopping application of a tube voltage with a limit tube current value corresponding to a maximum tube voltage value of an X-ray tube as a threshold are stored in storage means of an X-ray tube control apparatus beforehand according to the maximum tube voltage values, and further comprising:

an extraction step at which extraction means of said X-ray tube control apparatus extracts one from said plurality of limit tube current control programs stored in said storage means which corresponds to the maximum tube voltage value input at said input step; and an output step at which output means of said X-ray tube control apparatus outputs said limit tube current control program extracted by said extraction means.

17. An X-ray tube control method according to claim 14, wherein a plurality of focus lens control programs for controlling a focus lens in such a way as to minimize a focal point when an electron beam hits a target of an X-ray tube with a maximum tube voltage applied to the target are stored in storage means of an X-ray tube control apparatus beforehand according to the maximum tube voltage values, and further comprising:

an extraction step at which extraction means of said X-ray tube control apparatus extracts said focus lens control program from said plurality of focus lens control programs stored in said storage means which corresponds to the maximum tube voltage value input at said input step; and an output step at which output means of said X-ray tube control apparatus outputs said focus lens control program extracted by said extraction means.

18. The X-ray tube control method according to claim 14, wherein when there is no maximum tube voltage value on the warming-up programs which matches with the maximum tube voltage value input at said input step, the maximum tube voltage value input at said input step is associated with the warming-up programs stored in said storage means in such a way that the maximum tube voltage value on the warming-up program is greater than the maximum tube voltage value input at said input step and a difference between the maximum tube voltage value on the warming-up program and the maximum tube voltage value input at said input step becomes minimum.

* * * * *